United States Patent [19]

Gilles et al.

[11] 4,235,276

[45] Nov. 25, 1980

[54] METHOD AND APPARATUS FOR CONTROLLING CASTER HEAT REMOVAL BY VARYING CASTING SPEED

[75] Inventors: Herbert L. Gilles; Johnson Shipman, both of Bethlehem, Pa.

[73] Assignee: Bethlehem Steel Corporation, Bethlehem, Pa.

[21] Appl. No.: 30,580

[22] Filed: Apr. 16, 1979

[51] Int. Cl.[3] ..... B22D 11/16

[52] U.S. Cl. ..... 164/4; 164/413; 164/414

[58] Field of Search ..... 164/4, 154, 413, 414, 164/82, 443, 444, 89

[56] References Cited

U.S. PATENT DOCUMENTS

| | | | |
|---|---|---|---|
| 3,358,743 | 12/1967 | Adams | 164/414 |
| 3,886,991 | 6/1975 | Meier et al. | 164/414 |
| 4,006,633 | 2/1977 | Shipman et al. | 164/4 |

FOREIGN PATENT DOCUMENTS

| | | | |
|---|---|---|---|
| 493291 | 2/1976 | U.S.S.R. | 164/4 |

*Primary Examiner*—Robert D. Baldwin
*Assistant Examiner*—K. Y. Lin
*Attorney, Agent, or Firm*—Joseph J. O'Keefe; Michael J. Delaney; George G. Dower

[57] ABSTRACT

Breakouts due to insufficient skin thickness exiting below caster mold are prevented. Minimum mold heat removal rate is defined in terms of casting speed, mold faces, mold size, material grade and tundish superheat, then calculated, indicated and compared to actual measured values of heat removal rate. As a result of the comparison, caster preset speed correction is taken to automatically maintain the mold heat removal rate above the minimum level where breakouts occur.

24 Claims, 3 Drawing Figures

$$QL_2 = QA_2 \times S = \text{BTU/MIN./IN. OF MOLD "L" DIM.}$$

$$QA_2 = k_2 + k_3 \cdot \Delta T_2 \left[\frac{w \cdot t}{w+t}\right] = \text{BTU/IN.}^2$$

$$= 16.64 + \frac{0.267\,\Delta T_2\, w}{(w+10)}$$

WHEN: "t" = 10 & "w" = 32"—76";
S = 30—60 IPM

METHOD AND APPARATUS FOR CONTROLLING CASTER HEAT REMOVAL BY VARYING CASTING SPEED

BACKGROUND OF THE INVENTION

1. Field of the Invention

This invention relates broadly to continuous metal casting. More particularly, this invention relates to a method and apparatus for controlling caster mold heat removal to prevent breakouts by varying casting speed. The invention may be used in all sizes of strand casting machines in which solidification of a shell with liquid core starts in single or multiple water-cooled mold faces.

2. Description of the Prior Art

Generally, it is desirable to operate a continuous caster of metal billets, slabs and the like at the highest speeds possible to meet maximum production and utilization goals. However, in practice only optimum strand throughput at a predetermined allowable speed prevails, rather than at maximum speed, so as to avoid major disruptions in continuous caster operations. One such major disruption occurs when an improperly solidified strand breaks out because of insufficient heat transfer in the mold.

It has been discovered that numerous factors exist which lead to insufficient heat transfer when casting molten steel for example. First, low mold metal level due to either loss of metal level control or a build-up of an excessive slag layer when using a mold powder. The low metal level causes a reduction of residence time in the mold and thus reducing heat transfer. Second, A build-up of $A1_2 0_3$ content of the mold slag during casting of aluminum-killed steel which causes mold slag to become viscous and gummy and results in a significant loss in mold heat transfer. Third, in a rectangular mold, loss of narrow face taper increasing a strand-mold gap which reduces heat transfer on one or both narrow faces. Fourth, too high a casting speed which reduces residence time of a thin walled shell in the mold, thereby causing insufficient amounts of heat removal. Fifth, excessive temperature of liquid metal entering the mold which increases the mold heat load. Sixth, casting of wider and thicker slabs which reduce the surface area per volume of metal cast, thus causing more mold surface area to be used to extract the metal superheat and reducing the area available for formation of solid skin.

Caster operators are taught that a thicker skin may be formed in a caster mold to prevent breakout by manually reducing casting speed. This is based on known mold heat removal rate QA per square inch of strand surface which is speed dependent. However, there is lacking a prior art relationship defining when mold heat removal rate is insufficient, or in what manner caster speed corrective action should be taken. J. Shipman et al in U.S. Pat. No. 4,006,633 disclose how to satisfactorily measure and determine mold heat removal rate in single and multiple mold coolant flow circuits, but lacks direction as to determining minimum level of mold heat removal rate as well as caster speed correction. Earlier prior art is similarly deficient, or if mold heat removal is suggested, it requires a comprehensive analysis and determination of strand thermal and stress profiles all along the strand beyond the mold which must be combined with mold parameters.

SUMMARY OF THE INVENTION

One of the objects of this invention is to provide an improved method and apparatus for continuously controlling caster mold heat removal rate which will overcome the foregoing difficulties.

Another object of this invention is to provide a method and apparatus for determining caster minimum level of mold heat removal rate and caster corrective action to be taken in the control of mold heat removal.

Still another object of this invention is to provide an improved method and apparatus for controlling caster mold heat removal without considering such parameters as mold level, cast strand thermal or stress profiles.

The foregoing objects are attainable in casters with fixed or adjustable mold structures having either single or multiple coolant flow circuits by simply determining actual mold heat removal rate, determining minimum level of mold heat removal rate required to prevent a strand breakout, selectively comparing the actual with minimum level rates, and automatically modifying a caster preset speed as a result of the comparison beyond a predetermined percentage factor. The mold actual heat removal rate is computed from measurements including mold coolant flow rate, temperature differential across the mold, mold length and optionally caster speed, such as is taught by Shipman et al in U.S. Pat. No. 4,006,633 for both single and adjustable rectangular molds. The minimum level of mold heat removal rate is calculated from criteria including superheat of the metal, the heat of fusion and enough sensible heat to form a minimum skin thickness, taking into account strand width and thickness dimensions, steel grade, liquidus temperature based on ladle analysis, tundish temperature, and speed, but excluding mold level and strand thermal and/or stress profiles. When rectangular molds are used and both sheet and plate grades are cast, a comparator-controller automatically selects the wide or narrow mold face with the lowest actual heat removal rate and compares it with the calculated minimum level of mold heat removal rate and compares it with the calculated minimum level of mold heat removal rate to prevent a breakout for the grade cast, thereby generating a speed error signal which is used to proportionally modify a preset caster speed control signal.

DESCRIPTION OF THE PREFERRED EMBODIMENT

Figure 1:
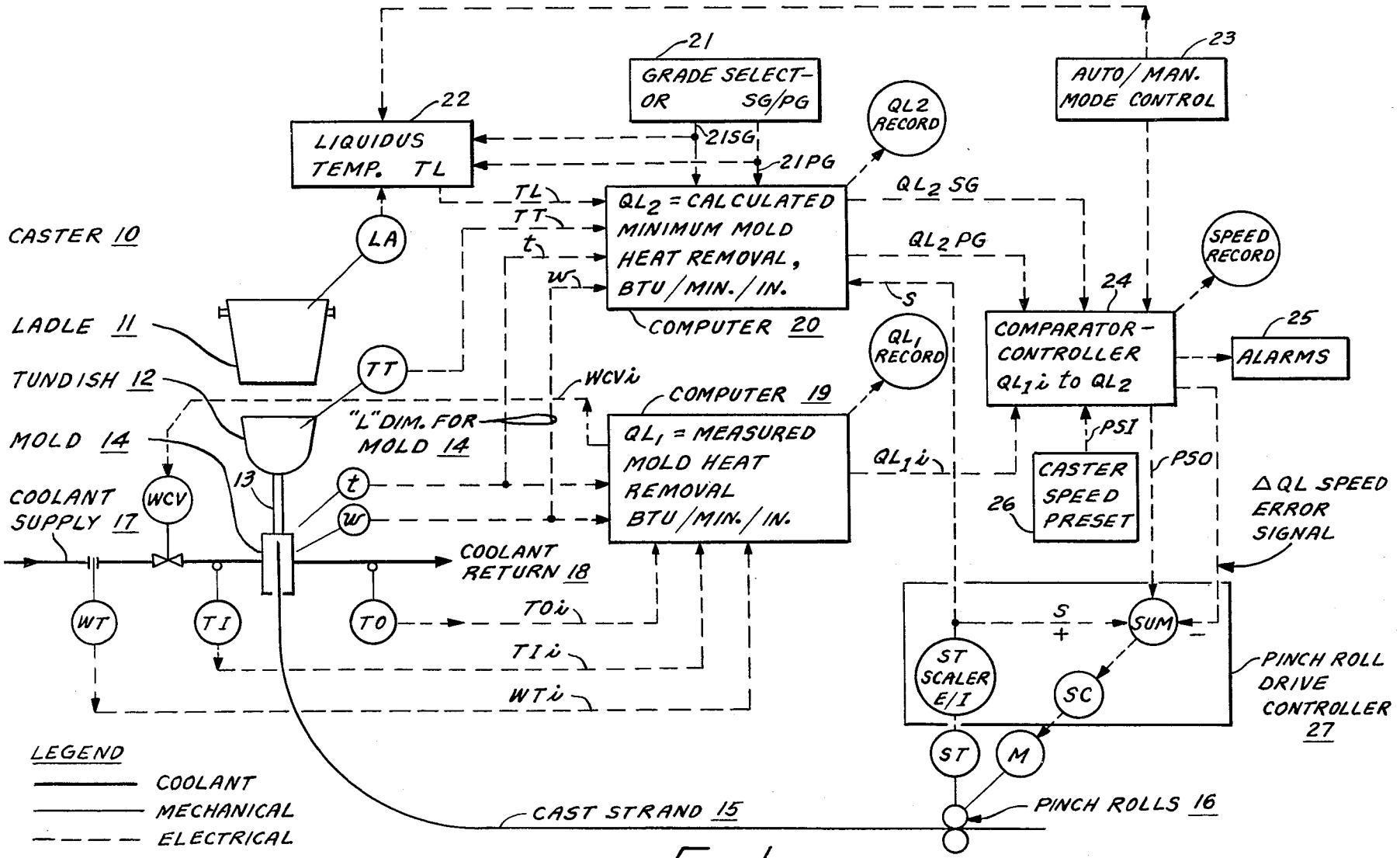
FIG. 1 is a block diagram of a continuous metal caster having a fixed size mold with varible cooling, metal feed, computing and speed control systems in which there is incorporated the present invention.

Referring to FIG. 1, continuous metal caster 10, or simply caster 10, will be presumed to have undergone start-up procedures and is operating in essentially a steady-state mode. Superheated molten metal was teemed from ladle 11 into tundish 12 and then fed controllably as hot metal stream 13 into caster mold 14. Mold 14 heat transfer, which is regulated a predetermined amount by coolant flow control valve WCV, effects solidification so that as cast strand 15 leaves mold 14 it continually consists of a liquid core and outer shell or skin of sufficient thickness to prevent a breakout.

Mold 14 instantaneous heat removal requirements vary as a function of mold hot metal level, mold size, other parameters described below, and cast strand 15 withdrawal rate as determined by pinch roll 16 operating in a preset speed control loop also described below. In order to accommodate a fluctuating mold heat transfer in the single coolant flow circuit shown in FIG. 1, flow control valve WCV is interposed between coolant supply 17, mold 14 and coolant return 18 and operates in response to a flow control signal from computer 19. In the case of mold 14 being an adjustable rectangular structure with four independent coolant flow circuits, each circuit has a flow control valve $WCV_i$ interposed between coolant supply 17 and coolant return 18. Computer 19 instrumentation is exemplified by an assembly of conventional analog-type computer and control elements such as are found in a Foxboro Spec. 200 analog computer.

Measuring means and computer means for determining and controlling actual mold 14 heat removal corresponding to computer 19 is disclosed in the Shipman et al U.S. Pat. No. 4,006,633. This patent is directed to both single and multiple coolant flow circuits having a separate instrument measuring and controlling computer for each flow circuit. Instead of each computer and measuring devices having an "i"th subscript, they carry N,S,E,W, designations corresponding to either wide or narrow mold faces as is done hereinbelow. Mold wide faces and narrow faces have unequal cooling rates.

Regardless of the number of coolant flow circuits used in mold 14, each computer 19 performs two functions. The first function of computer 19 is to generate a conventional coolant flow control signal $WCV_i$ for its associated flow control valve WCV in response to a coolant flow signal from a respective flow transmitter WT and a preset flow signal (not shown herein). The second function of computer 19 is to use Eq. 1, for example, to produce an actual heat removal $Q_i$ signal for comparison and recording purposes in response to signals representing coolant flow rate $WT_i$, coolant temperature in and out $TI_i$, $TO_i$ with respect to mold 14, all being fed to computer 19.

Actual heat removal rate may be expressed as either QL or QA for use with the present invention. QL is preferred herein because it references heat removal to mold face peripheral length "L", or width "w" and/or "t" thickness, in terms of BTU/min./in. of mold face length which is not dependent upon a speed parameter. Whereas, QA if used references heat removal to strand face surface area in terms of BTU/in.$^2$ and is speed dependent. In practice, each computer 19 determines what is designated hereinafter as $QL_1$ actual heat removal rate per unit length of mold face as follows:

$$QL_1 = \frac{W \times \Delta T_1 \times k_1 \times C_p}{L} = \text{BTU/min./in.} \qquad \text{Eq. 1}$$

where:

W = coolant flow rate in GPM $\Delta T_1 = TO - TI =$ coolant temperature rise, °F.

$k_1$ = constant = 8.33 lbs. per gal.

$C_p$ = specific heat BTU/lb. per °F. = 0.19

L = dimension of mold face in inches, and $QA_1 = QL_1 \div S$ where:

S = speed of cast strand leaving mold, inches/min. Mold 14 face length "L" dimensions shown in FIG. 1 are also fed to computer 19 in addition to coolant flow and thermal parameters. When mold 14 has a single face and single coolant flow circuit, the "L" dimension corresponds to mold face peripheral length data which is fed as a single input "L" (not shown) from a mold length data source to computer 19. Alternatively, when mold 14 is an adjustable rectangle having four faces each with an independent coolant flow circuit, the "L" dimension consists of mold wide face "w" and mold thickness or narrow face "t" dimensional data which are fed from respective mold data sources to corresponding inputs to separate computers 19.

Still referring to FIG. 1, computer 20 determines what is designated hereinafter as $QL_2$ calculated minimum mold heat removal rate per unit length of mold peripheral face so as to be on the same basis as $QL_1$. It has been discovered that the minimum level of mold heat removal rate necessary to prevent a breakout during caster 10 operation may be defined by the following equations:

$$Q = Q_s + Q_{sh} \qquad \text{Eq. 3}$$

$$QL_2 = \left[ k_2 + \frac{C_p \times \Delta T_2 \times w \times t \times \rho}{3456\,(w + t)} \right] S = \text{BTU/min./in.} \qquad \text{Eq. 4}$$

$$QL_2 = QA_2 \times S \qquad \text{Eq. 5}$$

$$QA_2 = k_2 + \frac{C_p \times \Delta T_2 \times w \times t \times \rho}{3456\,(w + t)} = \text{BTU/in.}^2 \qquad \text{Eq. 6}$$

$$QS_2 = \frac{3456 \times k_2\,(w + t)}{w \times t \times \rho} + C_p \Delta T_2 = \text{BTU/\#} \qquad \text{Eq. 7}$$

where equations 4 and 6 are for the individual mold faces, equation 7 is for the mold overall heat removal and:

$k_2$ = constant, determined as noted below

Q = total heat removal $Q_s$ = heat removed from cast strand skin $Q_{sh}$ = heat removed from superheat $C_p$ = liquid specific heat = BTU/# °F. = 0.19 p = density, #/ft.$^3$

S = speed, inches per min. (IPM)

t = slab thickness or narrow face of mold, inches $\Delta T_2$ = superheat above liquid temperature, = TT-TL, °F.

TL = Liquidus temperature, °F.

TT = Tundish temperature, °F.

w = slab width or wide face of mold, inches

Specifically for casting low carbon grade, aluminum-killed steel in molds 10" thick (t) by 32—76" wide (W) at casting speeds from 30—60 IPM (S), the equations defining the calculated minimum level of mold heat removal rate take the form:

$$QL_2 = 16.64 \times S + 0.267 \times S \times \Delta T_2 \frac{w}{w + 10} = \text{BTU/min./in.} \qquad \text{Eq. 8}$$

$$QA_2 = 16.64 \times 0.267 \times \Delta T_2 \frac{w}{w + 10} = \text{BTU/in.}^2 \qquad \text{Eq. 9}$$

-continued $$QS_2 = 11.83\frac{w+10}{w} + 0.19\Delta T_2 = \text{BTU}/\# \quad \text{Eq. 10}$$

where constant $k_2 = 16.64$ as determined from analyzing a large number of casts with a wide range of speeds, slag $A1_2O_3$ contents, tundish temperatures and slab widths.

Regardless of the number of coolant flow circuits used in mold 14, only one computer 20 having conventional analog computing elements is employed to determine $QL_2$ calculated minimum level of mold heat removal rate based on either broad Eq. 4 or simplified Eq. 8. Computer 20 produces a $QL_2$ output for recording and analyzing purposes, and either one of $QL_2SG$ or $QL_2PG$ outputs for comparison purposes depending upon the sheet grade SG or plate grade PG position of grade selector device 21.

Figure 2:
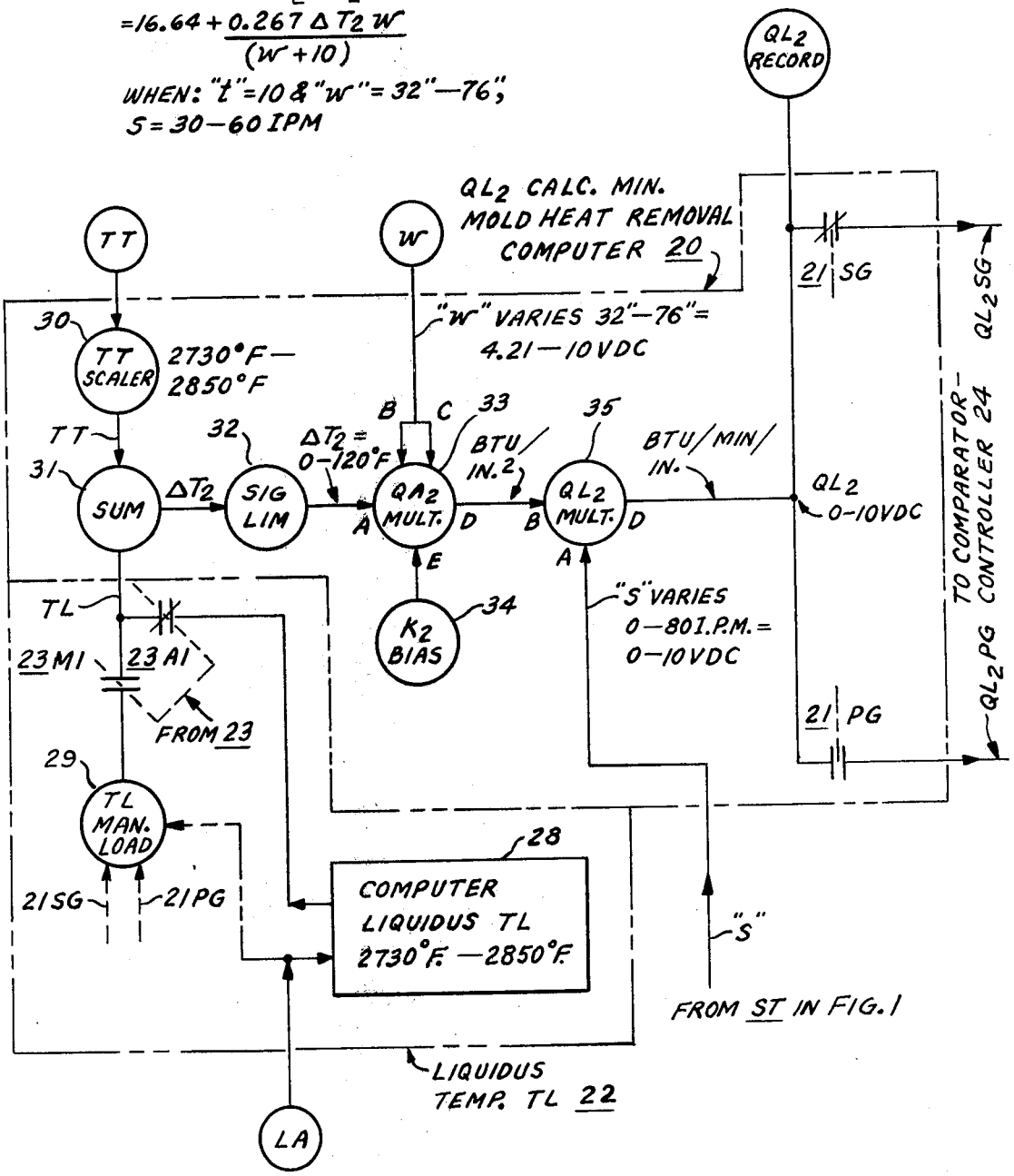
FIG. 2 is an instrumentation diagram of a computer used to calculate the minimum level of mold heat removal rate useful with either single or multiple faced mold designs in the FIG. 1 embodiment.

In order to calculate $QL_2$, $QL_2SG$ or $QL_2PG$, computer 20 received the following operating data from caster 10: (a) cast strand withdrawal speed S from pinch roll 16 drive tachometer ST; (b) tundish temperature data from sensor TT; (c) liquidus temperature data TL from device 22 which, as shown in FIG. 2, responds to ladle analysis data from sensor LA and auto/manual mode control data from device 23; and (d) "L" dimension data from mold 14 sensors for single coolant flow circuits, or "t" and "w" dimension data from mold 14 sensors for multiple coolant flow circuits, both as described above for computer 19 when determining $QL1_i$.

Computer 19 output(s) $QL_{1i}$ and computer 20 outputs $QL_2Sg$, $QL_2PG$ are fed to comparator controller 24 where $QL_i$ data is compared to $QL_2SG$ or $QL_2PG$ data using conventional analog computer and control elements. Comparator-controller 24 compares a preselected adjustable $QL_2SG$ or $QL_2PG$ as a calculated preset signal against one $QL_{1i}$ actual signal at the input of a proportional indicating controller. Controller output is $\Delta QL$ which is factored and represents a speed error signal used in caster 10 speed corrective action. When mold 14 has an adjustable rectangular structure, device 24 is also provided with signal selectors to select the lowest of $QL_{1i}$ actual signals for comparison with $QL_2Sg$ or $QL_2PG$ signal. Also device 24 provides different $\Delta QL$ control action for mold wide faces than narrow faces. In addition, device 24 includes monitoring circuits which signal alarm device 25 with heat removal and speed error abortive alarms based on exceeding preset signal levels.

When under automatic mode control established by device 23, comparator-controller 24 receives from caster speed preset 26 a preset speed input signal PSI simply for caster speed monitoring and feed-through purposes. Caster speed preset 26 may be either a manual load or a computer device which establishes in the PSI signal a desired withdrawal rate of cast strand 15 based on known criteria. This signal is fed through device 24 and becomes preset speed output signal PSO which, together with the $\Delta QL$ speed error signal, is fed to pinch roll drive controller 27.

Pinch roll drive controller 27 operates in a conventional preset caster speed feedback loop to maintain the withdrawal rate of cast strand 15 at the preset speed established by the PSO signal. This is done by algebraically summing the PSO signal at the SUM device which initially feeds a speed control signal to SC device, the latter powering drive motor M. Motor M drives pinch rolls 16, and therefore cast strand 15, at a speed sensed by speed tachometer ST. ST Scaler E/I scales and converts the ST signal into an actual speed signal S of proper units compatible with summer SUM as well as computer 20 which uses this signal as described above to calculate $QL_2$. At SUM, the actual speed signal S is combined with the preset speed signal PSO and ultimately causes pinch roll drive controller 27 to maintain pinch rolls 16 and cast strand 15 at a constant withdrawal rate.

The $\Delta QL$ speed error signal fed from comparator-controller 24 to SUM device in pinch roll drive controller 27 has the effect of modifying pinch roll 16 drive speed, and therefore cast strand 15 withdrawal rate. The amount of withdrawal speed correction action is predetermined by comparator-controller 24 and is different for narrow faces than wide faces of adjustable rectangular molds 14 as will be described below. Nevertheless, the withdrawal speed corrective action is defined as follows:

$\Delta QL = QL_{li} - QL_2 \geqq 0$,
No speed corrective action needed, or — 11

$\Delta QL = QL_{li} - QL < 0$,
Take speed correction action. — 12

Conditions leading to $\Delta QL$ speed corrective action during a caster 10 operation may occur as follows: First, $\Delta QL > 0$ and caster 10 is operating under a fixed set of conditions, no speed corrective action by controller 27 is required. Second, when a change occurs in caster 10 operation due to one or more of the following: (1) loss of metal level in mold 14; (0.2) slag deterioration such as increase in $Al_2O_3$ content; (0.3) loss of mold 14 narrow face taper in rectangular mold design; (0.4) caster 10 speed increase for any reason; and (0.5) increase in tundish 12 temperature as sensed by TT sensor; any or all of which may cause $\Delta QL < 0$, thus requiring speed corrective action by controller 27 in an amount determined by the magnitude of the $\Delta QL$ speed error signal.

Turning now to FIG. 2, a description will follow of liquidus temperature TL device 22 and of computer 20 which determines $QL_2$, the calculated minimum level of mold heat removal rate to prevent a breakout in cast strand 15. Generally, the analog instrumentation elements of computer 20 operate on ±0-10VDC input to produce a ±0-10VDC output, except where otherwise noted. Scalers are provided where necessary when another computer element is not equipped with this function.

FIG. 2 is exemplified with instrumentation elements to solve Eq. 8 in computer 20, the simplified equation for calculating minimum level of mold 14 heat removal rate. Further, the example is limited to a slab thickness or mold narrow face "t" dimension of 10", thereby simplifying the number of computing elements required to solve Eq. 8. Other numerical values may require additional multipliers. In addition, the example is limited to a slab width or mold wire face "w" dimension to a range of about 32" to about 76", and casting speed to a range of about 30IPM to about 60IPM, whereupon encountering dimension and speed parameters outside of their respective ranges may require an adjustment to the value of $k_2$. It will now be apparent that computer 20 may also be instrumented to solve broad Eq. 4, rather than simplifed Eq. 8 as requirements may dictate.

Liquidus temperature signal TL for use by computer 20 in solving either Eq. 4 or 8 is fed from one of two sources in device 22, depending upon which source is selected by auto./manual mode control 23. One source is computer liquidus 28 which provides a TL signal representing a liquidus temperature range of from 2730° F. to 2850° F. This is based on ladle analysis provided by sensor LA, or other source not shown. The second source is manual load device 29 which provides the same TL signal as computer liquidus source 28. However, it is manually set by a caster operator based on tabular data characterized by data consisting of ladle analysis LA and sheet or plate grate 21SG, 21PG variables. Under automatic mode of control, n.c. contacts 23A1 select the computer liquidus source 28 to feed the TL signal computer 20, n.o. contacts 23M1 preventing the selection of manual load source 29. Under manual mode of control, contacts 23M1 are closed and contacts 23A1 open, thereby selecting manual load source 29 to provide the TL signal to computer 20 and preventing the selection of source 28.

The temperature differential signal required to solve Eq. 4 or 8 is developed by scaling the tundish temperature signal TT in TT Scaler 30 in the range of 2730° F.-2850° F., applying it to SUM device 31 where the liquidus temperature signal TL is subtracted from the tundish temperature signal TT. This causes SUM device 31 to generate a $\Delta T_2$ temperature differential signal having a range of 0°—120° F. Signal Limiting device 32 limits $\Delta T_2$ to a range of 0°—120° F. even though in practice there may develop a greater difference between the TT and TL signals.

In solving for the $QA_2$ portion of Eq. 4 or 8 when strand thickness or mold narrow face dimension "t"=10", the $\Delta T_2$ signal from signal limiter 32 is fed to the "A" multiplying input of $QA_2$ multiplier/divider/biaser 33 such as Foxboro #TI-2AP-130. Device 33 has multiplying inputs "A" and "B", dividing input "C", biasing input "E", an output at "D" and scaling and biasing features at all but the "E" input. The $\Delta T_2$ input at "A" is scaled internally according to constant $$k_3 = \frac{\text{"}t\text{"} \times Cp \times \rho}{3456} = 0.267.$$

The parameter "w" from the strand width of mold 14 wide face sensor is used in both numerator and denominator, therefore it is fed to inputs "B" and "C", the "C" input being biased for "t" or 10". When "t" is other than 10", scaling must be done proportionally. The $k_2$ constant is added and scaled at the "E" input based on the setting of $k_2$ Bias device 34. The output at "D" of $QA_2$ multiplier 33 is now the calculated minimum level of mold 14 heat removal rate in terms of BTU/in$^2$ of mold 14 surface area.

The $QA_2$ output signal from device 33 is fed to the "B" input of $QL_2$ multiplier 35 where it is multiplied by a 0-80IPM caster speed signal "S" applied to the "A" input. The output at "D" of $QL_2$ multiplier 35 is now in terms of calculated BTU/min./in. of mold 14 face length. This output is recorded and fed to comparator-controller 24 either as a $QL_2SG$ sheet grade signal through normally closed contact 21SG or as a $QL_2PG$ plate grade signal when contact 21PG is closed and the 21SG contact is opened by the grade selector 21.

Figure 3:
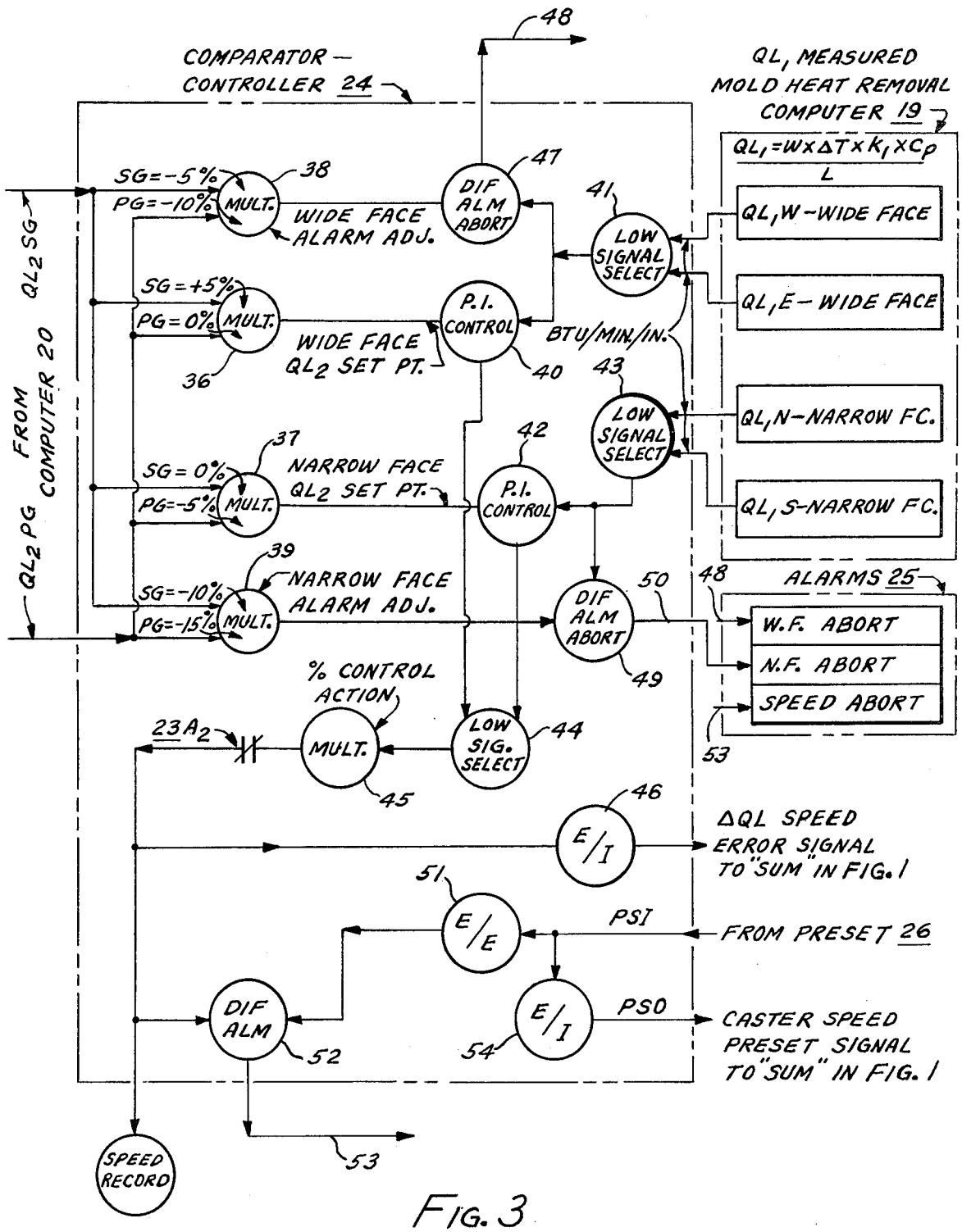
FIG. 3 is an instrumentation diagram of the comparator-controller used to automatically select the wide or narrow mold face of an adjustable rectangular mold with the lowest actual mold heat removal rate for use with the FIG. 1 embodiment.

Referring now to FIG. 3, a description of comparator-controller 24 will follow. In device 24, the same type of instrumentation elements as used in computer 20 are used to compare actual $QL_{1i}$-calculated $QL_2SG$ or $QL_2PG=\Delta QL$ speed error signal. The arrangement shown in FIG. 3 is based on a four-circuit cooling system for a rectangular mold 14 having a separate computer 19 for each of the two wide faces and each of the two narrow faces, these being identified as producing mold 14 actual heat removal rates $QL_1W$, $QL_1E$, $QL_1N$ and $QL_1S$, respectifely. In practice, sheet grade and plate grade calculated $QL_2$ may require different amounts of caster 10 speed corrective action. The same may be true for mold wide faces because of unequal cooling rates, versus mold narrow faces as well as differences in character of control action required between the wide faces versus the narrow faces. For these reasons, comparator-controller 24 is provided with separate circuit adjustments, signal selectors and controllers for automatically selecting the lowest measured $QL_i$ signal from computer 19 and using it to compare with the preselected calculated $QL_2$ signal to arrive at the $\Delta QL$ speed error signal. Separate monitoring and alarming in device 25 of mold 14 heat removal and caster 10 speed impending abortive conditions are also provided by device 24.

Comparator-controller 24 has provisions for functioning as follows. Assuming that the calculated sheet grade $QL_2SG$ signal and calculated plate grade $QL_2PG$ signal are alternately fed to the respective inputs of multipliers 36,37,38,39, respectively. Sheet grade heat transfer properties are about 5% better than plate grade properties and mold 14 wide face heat transfer properties are also about 5% better than mold 14 narrow face properties. For these reasons, the SG,PG inputs of multiplier 36 are preset at about +5%, 0% respectively, thereby causing multiplier 36 to output a wide face $QL_2$ set point signal. Similarly, the SG,PG inputs of multiplier 37 are preset at about 0%, −5% respectively, thereby causing multiplier 37 to output a narrow face $QL_2$ set point signal.

The wide face $QL_2$ set point signal is fed to a corresponding input of proportional indicating controller 40. Here it is compared to the lowest $QL_1$ measured signal from either of the $QL_1W$ or $QL_1E$ wide face source in computer 19 as determined by low signal selector 41. This device is a Foxboro #TI-2AP-160 Hi/Lo signal selecting device set to pass the lowest signal when less than zero. The lowest wide face $QL_1W$ or $QL_1E$ signal indicates which of the wide faces of mold 14 is producing the smaller amount of mold 14 heat removal, thereby requiring caster 10 speed corrective action to prevent a breakout in cast strand 15, regardless of whether strand 15 is a sheet grade or plate grade product. The control action of P.I. controller 40 is chaacterized for mold 14 wide face control action.

The narrow face $QL_2$ set point signal is fed to a corresponding input of proportional indicating controller 42. Here it is compared to the lowest $QL_1$ measured signal from either of the $QL_1N$ or $QL_1S$ narrow face source in computer 19 as determined by low face signal selector 43, a device the same as device 41. Similarly, the lowest narrow face $QL_1N$,$QL_1S$ indicates which of the narrow faces of mold 14 is producing the smaller amount of mold 14 heat removal and thus requiring caster 10 speed corrective action. The control action of device 42 is characterized for mold 14 narrow face control action.

Control output signal from both proportional indicating controllers 40,42 represent mold 14 heat removal rate error between their respective selected wide face or narrow face, as well as the different character of respective control action when their lowest selected BTU/min./in. source was less than zero. The two proportional control output signals from controllers 40,42 having different control action are fed to low signal selector 44, a device the same as devices 41,43. Device 44 selects the lowest of the two wide face or narrow face control error signals when less than zero and feeds them as ΔQL speed error signal to multiplier 45. The ΔQL speed error signal has the proper preselected control action for the source of heat removal rate error in mold 14, regardless of whether a sheet grade or plate grade casting was preselected by grade selector 21. Multiplier 45 is adjusted to provide the desired percentage of maximum ΔQL control action effective by way of voltage to current converter 46 on pinch roll drive controller 27 in FIG. 1.

The ΔQL speed error signal is effective only when auto./manual mode control 23 in automatic mode and contacts 23A2 are closed. When device 23 is in manual mode contacts 23A2 open and prevent the ΔQL speed error signal from being fed to pinch roll drive controller 27.

Monitoring functions of mold 14 heat removal rate errors and caster speed error parameters are carried out simultaneoulsy with the development of set points noted above. Monitoring functions are set to be activated at a level of about 10% before abort conditions will arise. For these reasons, the SG,PG inputs of wide face alarm adjust multiplier 38 are preset at about −5%, −10% respectively. This causes multiplier 38 to output a proportioned $QL_2SG$ or $QL_2PG$ signal to differential alarm relay 47 where it is compared to the lowest wide face $QL_1W$ or $QL_1E$ signal determined by low signal selector 41. When the difference in signals is within the present 10% of approaching control saturation, relay 47 sends a mold 14 wide face abort alarm signal over lead 48 to W.F. Abort device in alarm device 25.

The SG,PG inputs of narrow face alarm adjust multiplier 39 are preset at about −10%, −15%, respectively. This causes multiplier 39 to output a proportional $QL_2SG$ or $QL_2PG$ signal to differential alarm relay 49 where it is compared to the lowest narrow face $QL_1N$ or $QL_1S$ signal determined by low signal selector 43. When the difference in signals is within the preset 10% of approaching control saturation, relay 49 sends a mold 14 narrow face abort alarm signal over lead 50 to N.F. Abort device in alarm device 25.

During automatic mode control when contacts 23M2 are open as established by device 23, the caster speed preset input PSI signal fed from preset 26 is passed through voltage-to-voltage converter 51 to differential alarm relay 52. Here it is compared to the ΔQL speed error signal output from multiplier 45. A predetermined difference between the two signals indicating approach of control saturation causes relay 52 to send a speed abort alarm signal over lead 53 to Speed Abort device in alarm device 25.

The caster preset speed PSI signal is fed into comparator-controller 24 as a voltage variable signal for the purpose of comparing it with the ΔQL signal and determining the speed abort condition referred to above. This signal is fed out of device 24 through voltage-to-current converter 54 back to SUM device in controller 27 as the caster preset speed output signal PSO mentioned above.

It will now be apparent that the analog computing functions of computers 19,20, liquidus temperature TL source 22, and comparator-controller 24 may be performed by digital computer apparatus, either in individual components or in a single minicomputer.

In FIGS. 1-3 both manual and automatic modes of control are established by control device 23, caster 10 operation is such that actual mold heat removal rate $QL_{1i}$ in mold 14 as determined by measurement and calculation methods in computer 19 is compared to calculated minimum mold heat removal rate $QL_2SG$ or $QL_2PG$ as determined by calculation methods in computer 20, thereby preventing breakouts in cast strand 15 below mold 14 due to insufficient strand skin thickness. The various control modes differ in ways in which the comparison takes place in comparator-controller 24 and is used to control the strand 15 casting speed S.

First, under manual mode of control, the operator compares the measured mold heat removal rate $QL_{1i}$ by computer 19 to the minimum mold level $QL_2SG$ or $QL_2PG$ published in tables or charts covering one or more of the following operating parameters: tundish temperature, steel grade, casting speed, strand width or wide face mold dimension and the like. If actual mold heat removal rate $QL_{1i}$ falls below the minimum rate level $QL_2SG$ or $QL_2PG$, then the operator of caster 10 manually reduces caster preset speed PSI at device 26. If the actual mold heat removal rate is significantly above the calculated minimum rate level, the caster 10 operator has the option to increase casting speed S. $QL_{1i}$, $QL_2$ and ΔQL records are available for guiding caster 10 operator in adjusting caster speed S.

Second, under automatic mode control, the comparison of actual mold heat removal rate $QL_{1i}$ determined in computer 19 is automatically compared with calculated minimum level $QL_2SG$ or $QL_2PG$ determined in computer 20. This comparison takes place in comparator-controller 24 which generates the ΔQL speed error signal. ΔQL speed error signal automatically biases or modifies the pinch roll 15 drive controller 27 to vary casting speed S only in the event that the actual mold heat removal rate reaches the minimum mold level. When the actual mold heat removal rate exceeds the minimum level, ΔQL is zero and the casting speed S remains unchanged at the preset value of PSO. When ΔQL is less than zero, the speed error signal automatically varies casting speed S to maintain actual heat removal rate at the minimum rate level, or some fixed increment above the minimum rate level, or even within a range which may be defined as a function of caster speed or other variables.

Third, caster 10 installations embodying automatic biasing or modifying of the speed control system, such as in pinch roll drive controller 27, device 23 provides means for returning to manual operating mode whereby caster 10 speed control is transferable back to the operator who adjusts caster preset speed control device 26.

We claim:

1. A method of controlling heat removal from a continuous metal caster having cooling means for solidifying strand casting and variable drive means with a presetable feedback loop for controllably withdrawing the strand as cast, the method which comprises:

(a) determining actual heat removal rate $QL_{1i}$ of the cooling means during strand casting;

(b) determining a calculated minimum level of heat removal rate according to either:

$$QL_2 = \left[ k_2 + \frac{C_p \times \Delta T_2 \times w \times t \times \rho}{3456\,(w + t)} \right] S = \text{BTU/min./in.}$$

or $$QA_2 = k_2 + \frac{C_p \times \Delta T_2 \times w \times t \times \rho}{3456\,(w + t)} = \text{BTU/in.}^2$$

where:

$k_2$=predetermined constant $C_p$=liquid specific heat=BTU/# per °F.=0.19

$\rho$=density, #/ft.$^3$

S =speed, inches per min. (IPM)

t =slab thickness or narrow face of mold, inches $\Delta T_2$=superheat above liquid temperature, =TT-TL, °F.

TL =Liquidus temperature, °F.

TT =Tundish temperature, °F.

w =slab width or wide face of mold, inches, as required of the cooling means to prevent strand breakout during casting;

(c) comparing outputs from only step (a) with step (b) and as a result generating a speed error signal according to either:

$$\Delta QL = QL_{1i} - QL_2 \geqq 0$$

No speed corrective action needed, or $$\Delta QL = QL_{1i} - QL_2 < 0$$

Take speed corrective action, based on a predetermined difference between the actual and calculated heat removal rates; and (d) modifying the preset speed of the caster drive means as a function of only the speed error signal so that the actual heat removal rate will exceed the calculated minimum level thereof.

2. The method of claim 1 wherein the actual and calculated heat removal rates are based on unit length of the cooling means.

3. The method of claim 1 wherein the actual and calculated heat removal rates are based on unit surface area of the strand.

4. The method of claim 1 wherein determining the actual heat removal rate occurs by measuring parameters in at least one of plural coolant flow circuits of the cooling means.

5. The method of claim 1 wherein the cooling means includes a solidification mold and the actual and calculated heat removal rates are based on unit length of the mold face periphery.

6. The method of claim 5 wherein the mold size is adjustable and the heat removal rates are based on unit length of at least one face of the mold.

7. The method of claim 1 wherein the cooling means includes an adjustable solidification mold with plural faces, each with independent coolant flow circuits and some of which produce unequal cooling rates, and wherein the comparing step is operating to automatically select the lowest level actual heat removal rate present for use in generating the speed error signal.

8. The method of claim 1 wherein determining the calculated minimum level of heat removal rate output is varied by a preselectable grade property of the strand to be cast, thereby adjusting the speed error signal proportionally.

9. The method of claim 1 wherein the comparing step includes limiting the generating of the speed error signal to a predetermined percentage of maximum and correspondingly the modification of the preset caster speed.

10. The method of claim 1 further including the step of:

(e) recording or monitoring one or more parameters including the calculated minimum level of heat removal rate and the caster speed error signal.

11. The method of claim 1 further including the step of:

(f) alarming impending abortive condition when the lowest actual mold heat removal rate level will no longer exceed the calculated minimum level thereof.

12. A method of controlling heat removal from a continuous metal caster having cooling means for solidifying strand casting, the method which comprises:

(a) controllably withdrawing the strand as cast using variable drive means with a presetable feedback loop;

(b) determining actual heat removal rate $QL_{1i}$LI of the cooling means during strand casting;

(c) determining a calculated minimum level of heat removal rate according to either:

$$QL_2 = \left[ k_2 + \frac{C_p \times \Delta T_2 \times w \times t \times \rho}{3456\,(w + t)} \right] S = \text{BTU/min./in.}$$

or $$QA_2 = k_2 + \frac{C_p \times \Delta T_2 \times w \times t \times \rho}{3456\,(w + t)} = \text{BTU/in.}^2$$

where:

$k_2$=predetermined constant $C_p$=liquid specific heat=BTU/# per ° F.=0.19

$\rho$=density, #/ft.$^3$

S=speed, inches per min. (IPM)

t=slab thickness or narrow face of mold, inches $\Delta T_2$=superheat above liquid temperature,=TT-TL, °F.

TL=Liquidus temperature, °F.

TT=Tundish temperature, °F.

w=slab width or wide face of mold, inches, required of the cooling means to prevent strand breakout during casting;

(d) comparing outputs from only step (b) with step (c) and as a result generating a speed error signal according to either:

$$\Delta QL = QL_{1i} - QL_2 \geqq 0$$

No speed corrective action needed, or $$\Delta QL = QL_{1i} - QL_2 < 0$$

Take speed corrective action based on a predetermined difference between the actual and calculated heat removal rates; and (e) modifying the preset speed of the caster drive means as a function of only the speed error signal so that the actual heat removal rate will exceed the calculated minimum level thereof.

13. Apparatus for controlling heat removal from a continuous metal caster having cooling means for solidifying strand casting and variable drive means with a presetable feedback loop for controllably withdrawing the strand as cast, the apparatus comprising:

(a) first plural means for determining actual heat removal rate $QL_{1i}$ of the cooling means during strand casting;

(b) second plural means for determining a calculated minimum level of heat removal rate according to either:

$$QL_2 = \left[ k_2 + \frac{C_p \times \Delta T_2 \times w \times t \times \rho}{3456\,(w + t)} \right] S = \text{BTU/min./in.}$$

or $$QA_2 = k_2 + \frac{C_p \times \Delta T_2 \times w \times t \times \rho}{3456\,(w + t)} = \text{BTU/in.}^2$$

where:

$k_2$=predetermined constant $C_p$=liquid specific heat=BTU/# per °F.=0.19

$\rho$=density, #/ft.$^3$

S=speed, inches per min. (IPM)

t=slab thickness or narrow face of mold, inches $\Delta T_2$=superheat above liquid temperature,=TT-TL, °F.

TL=Liquidus temperature, °F.

TT=Tundish temperature, °F.

w=slab width or wide face of mold, inches, as required of the cooling means to prevent strand breakout during casting;

(c) third means for comparing outputs from only means (a) with means (b) and as a result generating a speed error signal according to either:

$$\Delta QL = QL_{1i} - QL_2 \geqq 0$$

No speed corrective action needed, or $$\Delta QL = QL_{1i} - QL_2 < 0$$

Take speed corrective action, based on a predetermined difference between the actual and calculated heat removal rates; and (d) said third means including control means for modifying the preset speed of the caster drive means as a function of only the speed error signal so that the actual heat removal rate will exceed the calculated minimum level thereof.

14. The apparatus of claim 13 wherein the first and second plural means determine their actual and calculated heat removal rates based on unit length of the cooling means.

15. The apparatus of claim 13 wherein the first and second plural means determine their actual and calculated heat removal rates based on unit surface area of the strand.

16. The apparatus of claim 13 wherein the first plural means mesures parameters and determines its actual heat removal rate in at least one of plural coolant flow circuits of the cooling means.

17. The apparatus of claim 13 wherein the cooling means includes a solidification mold and the first and second plural means determine their heat removal rates based on unit length of the mold face periphery.

18. The apparatus of claim 17 wherein the mold size is adjustable and the first and second plural means heat removal rates are based on at least one face of the mold.

19. The apparatus of claim 13 wherein the cooling means includes an adjustable solidification mold with plural faces, each with independent coolant flow circuits and some of which produce unequal cooling rates, and wherein the third means automatically selects the lowest level actual heat removal rate present for use in generating the speed error signal.

20. The apparatus of claim 13 wherein the second plural circuit means determining the calculated minimum level of heat removal rate output is varied by a preselectable grade property of the strand to be cast, thereby adjusting the speed error signal proportionally.

21. The apparatus of claim 13 wherein the third circuit means limits the generating of the speed error signal to a predetermined percentage of maximum and correspondingly the modification of the preset caster speed.

22. The apparatus of claim 13 further including:

(e) means for recording or monitoring one or more parameters including the calculated minimum level of heat removal rate and the caster speed error signal.

23. The apparatus of claim 13 further including:

(f) means for alarming impending abortive condition when the lowest actual mold heat removal rate level will no longer exceed the calculated minimum level thereof.

24. Apparatus for controlling heat removal from a continuous metal caster having cooling means for solidifying strand casting, the apparatus comprising:

(a) variable drive means with a presetable feedback loop for controllably withdrawing the strand as cast;

(b) first plural means for determining actual heat removal rate $QL_{1i}$ of the cooling means during strand casting;

(c) second plural means for determining a calculated minimum level of heat removal rate according to either:

$$QL_2 = \left[ k_2 + \frac{C_p \times \Delta T_2 \times w \times t \times \rho}{3456\,(w + t)} \right] S = \text{BTU/min./in.}$$

or $$QA_2 = k_2 + \frac{C_p \times \Delta T_2 \times w \times t \times \rho}{3456\,(w + t)} = \text{BTU/in.}^2$$

where:

$k_2$=predetermined constant $C_p$=liquid specific heat=BTU/# per °F.=0.19

$\rho$=density, #/ft.$^3$

S=speed, inches per min. (IPM)

t=slab thickness or narrow face of mold, inches $\Delta T_2$=superheat above liquid temperature,=TT-TL, °F.

TL=Liquidus temperature, °F.

TT=Tundish temperature, °F.

w=slab width or wide face of mold, inches, as required of the cooling means to prevent strand breakout during casting;

(d) third means for comparing outputs from only means (b) with means (c) and as a result generating a speed error signal according to either:

$$\Delta QL = QL_{1i} - QL_2 \geqq 0$$

No speed corrective action needed, or $$QL_{1i} - QL_2 < 0$$

Take speed corrective action,
based on a predetermined difference between the actual and calculated heat removal rates; and (e) said third means including control means for modifying the preset speed of the caster drive means as a function of only the speed error signal so that the actual heat removal rate will exceed the calculated minimum level thereof.

* * * * *

CERTIFICATE OF CORRECTION

PATENT NO. : 4,235,276

DATED : November 25, 1980

INVENTOR(S) : Herbert L. Gilles etal.

It is certified that error appears in the above-identified patent and that said Letters Patent are hereby corrected as shown below:

Col. 4, line 6, after the equation the word --Eq. 2-- should be inserted.

Col. 4, line 8, the sentence beginning with "Mold" should be the beginning of a new paragraph.

Col. 4, line 50, "p" should be the Greek rho (symbol) --$\rho$--.

Col. 6, line 19 and 20 should all be in one line and before the numeral "11" the word --Eq.-- should be inserted.

Col. 6, line 22 and 23 should all be in one line and after the numeral "12" the word --Eq.-- should be inserted.

Col. 6, line 24, "correction" should read --corrective--.

Col. 8, sentence beginning on line 7 and ending line 11 is incorrect, it should read:

--The same may be true for mold wide faces versus mold narrow faces because of unequal cooling rates as well as differences in character of control action required between the wide faces versus the narrow faces.--

UNITED STATES PATENT AND TRADEMARK OFFICE

CERTIFICATE OF CORRECTION

PATENT NO. : 4,235,276

DATED : November 25, 1980

INVENTOR(S) : Herbert L. Gilles et al.

It is certified that error appears in the above-identified patent and that said Letters Patent are hereby corrected as shown below:

Col. 9, line 34, "present" should read --preset--.

Col. 12, line 22, claim 12, subparagraph (b) delete "LI".

Col. 13, line 57, claim 16, "mesures" should read --measures--.

Col. 14, line 68, claim 24, subparagraph (~~b~~ c), "$QL_{1i} - QL_2 < 0$" should read -- $\Delta QL_{1i} = QL_2 < 0$--.

Signed and Sealed this

Twenty-sixth Day of May 1981

[SEAL]

Attest:

RENE D. TEGTMEYER

Attesting Officer

Acting Commissioner of Patents and Trademarks